US006389989B1

(12) United States Patent
Hagerty

(10) Patent No.: US 6,389,989 B1
(45) Date of Patent: May 21, 2002

(54) TWIN SHEET PRESSURE FORMED PALLET

(75) Inventor: James P. Hagerty, Granite Falls, NC (US)

(73) Assignee: PL Eagle, LLC, Granite Falls, NC (US)

( * ) Notice: Subject to any disclaimer, the term of this patent is extended or adjusted under 35 U.S.C. 154(b) by 0 days.

(21) Appl. No.: 09/754,137

(22) Filed: Jan. 5, 2001

(51) Int. Cl.[7] ..... B65D 19/00
(52) U.S. Cl. ..... 108/57.25; 108/901
(58) Field of Search ..... 108/901, 56.1, 108/56.3, 57.16, 57.25, 57.27, 57.29, 57.33

(56) References Cited

U.S. PATENT DOCUMENTS 3,664,271 A * 5/1972 Wolder et al. ..... 108/901 X
4,428,306 A 1/1984 Dresen et al.
5,046,434 A 9/1991 Breezer et al.
5,794,544 A * 8/1998 Shuert ..... 108/901 X
6,018,927 A * 2/2000 Major ..... 108/57.25 X
6,138,582 A * 10/2000 Fujii et al. ..... 108/57.25

FOREIGN PATENT DOCUMENTS

DE 4305999 * 9/1994 ..... 108/51.11

* cited by examiner

*Primary Examiner*—Janet M. Wilkens
(74) *Attorney, Agent, or Firm*—Vickers, Daniels & Young

(57) ABSTRACT

A pallet formed of a pair of thermoplastic sheets molded and fused together. The sheets have configurations that impart high stiffness and high strength, and the ability to be stacked on full pallets or nested on empty pallets. In particular, the molded configurations enable the sheets to be fused at a plurality of planes including mutually perpendicular planes for high strength union of the sheets. The pallet is especially suited for use with generally cubic milk crates.

22 Claims, 7 Drawing Sheets

TWIN SHEET PRESSURE FORMED PALLET

BACKGROUND OF THE INVENTION

The invention relates to pallets used for material handling and storage and, in particular, to improvements in molded plastic pallets.

PRIOR ART

It is known to mold pallets of plastic and/or other materials thus departing from traditional wood slat construction. More specifically, it is known from U.S. Pat. No. 4,428,306 to Dresen et al. and U.S. Pat. No. 5,046,434 to Breezer et al., for example, to mold pallets of two sheets fused or otherwise joined together. The sheets are typically molded with shallow grooves to increase their individual stiffness. These patents teach that the main areas of the two sheets be arranged relatively close together and adjacent the top plane of the pallet. Commonly, pallets of this type have molded feet that depend downwardly from the main planes of the double sheets at locations spaced throughout the plan area of the pallet. These double sheet pallets with depending feet are limited in their rigidity and strength as a result of the relatively close proximity of the sheets. Moreover, a pallet of this style often cannot be practically stacked onto another loaded pallet because the legs or feet may not properly register with the goods or packages on the loaded pallet. Still further, the relatively small surface areas represented by the feet can produce relatively high unit pressure on the goods or containers on an underlying loaded pallet.

SUMMARY OF THE INVENTION

The invention provides an improved molded plastic pallet that achieves a high rigidity and strength for its material content or weight and that is readily stackable onto either a loaded pallet or onto an empty pallet. The disclosed pallet is comprised of a pair of sheets that are molded into unique configurations. The sheets provide upper and lower platforms with relatively large surface areas for adequately supporting a load and for stabilizing the pallet when it is stacked on a loaded pallet.

The sheets are molded with interfitting formations that support the upper platform or deck above the lower platform or base a vertical distance adequate to receive the carrying forks of a lift truck or a floor jack. The formations, likewise, are configured to provide generous horizontal clearance for reception of the forks while preventing undue distortion or structural failure under load.

More particularly, the formations are configured to adequately transfer the load on the upper deck to the carrying forks or to the base without buckling or other gross distortion.

The disclosed pallet is especially useful for transporting and storing conventional milk crates which typically are molded plastic and are generally cubic in shape. The pallet is arranged to carry such crates in 3×3 layers (9 crates per layer) and with a stack height of 3 layers on each pallet. In this milk crate application, loaded pallets constructed in accordance with the invention can be stacked 3 pallets high with the base of successive loaded pallets safely and stably resting on the tops of the crates of an upper layer of an underlying loaded pallet. The pallet of the invention includes on the top deck a peripheral flange that horizontally locates and stabilizes the milk crates. Moreover, this upper flange is configured to receive a lower base flange of another identical pallet in a nesting fashion thereby facilitating stacking of empty pallets.

The disclosed pallet is preferably produced by forming the upper and lower sheets, made of thermoplastic material, into their configurations on shaped aluminum tools through application of heat, vacuum and/or pressure. Once molded to form, the sheets are pressed together using their forming tools as platens. This pressing operation is done while the sheets are at an elevated temperature thereby causing the sheets to fuse together at local surface areas of contact. The surface areas where fusion occurs, ideally, are provided with relief zones, typically in the nature of grooves in one of the sheets. The relief zones allow a small amount of sheet material to squish out from the contact areas to ensure that contact and fusion occurs at all intended fusion areas regardless of slight variations in material thickness, molded form, and/or relative positions of the tools when pressing the sheets together.

DESCRIPTION OF THE PREFERRED EMBODIMENT

Figure 1:
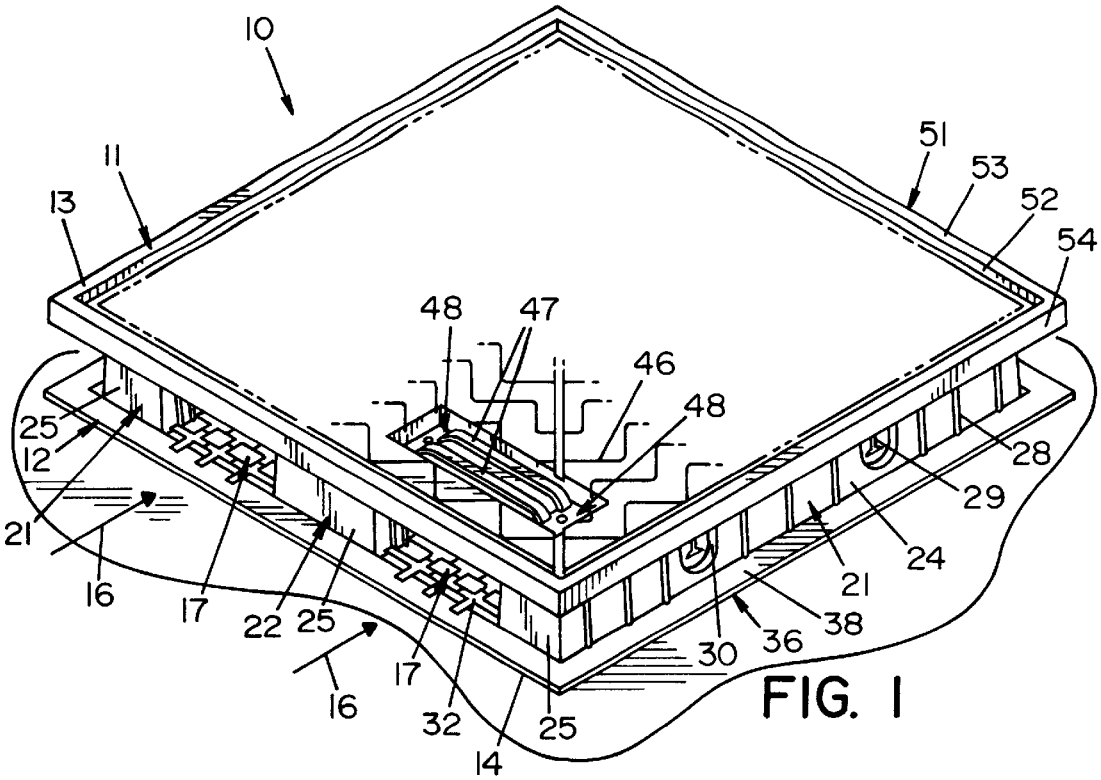
FIG. 1 is an isometric view of a pallet constructed in accordance with the invention, only a portion of the configuration of a top sheet thereof being illustrated for simplification.

A pallet 10, constructed in accordance with the invention, comprises a pair of plastic sheets 11 and 12 first formed into mating configurations and then pressed and fused together. A separate aluminum tool (not shown) is used to form each of the sheets 11 and 12. It will be understood that the tool forming the upper or top sheet 11 is disposed on an upper face 13 of the top sheet and the tool forming the bottom sheet 12 is disposed on a lower face 14 of the bottom sheet. The tools have shapes complementary to the desired finished shapes of the respective sheets 11 and 12. These shapes are discussed in some detail hereinbelow. The sheets 11, 12, which typically are of the same material such as high molecular weight polyethylene (HMWPE) are heated to a temperature sufficient to permit them to be molded into the shape of the tools with a vacuum (less than atmospheric pressure) applied between a tool and a sheet and/or a fluid pressure (greater than atmospheric pressure) applied to the exterior of a sheet. By way of example, the sheets 11, 12 can have a starting gauge of 0.300 inch; the disclosed pallet made with this material will have a weight of approximately 34.5 pounds. With the upper and lower sheets 11, 12 properly formed on their respective tools and with the sheets having a temperature of about between 300 and 350° F. the tools are pressed towards one another and the sheets become fused together at certain locations discussed more fully below.

Figure 2:
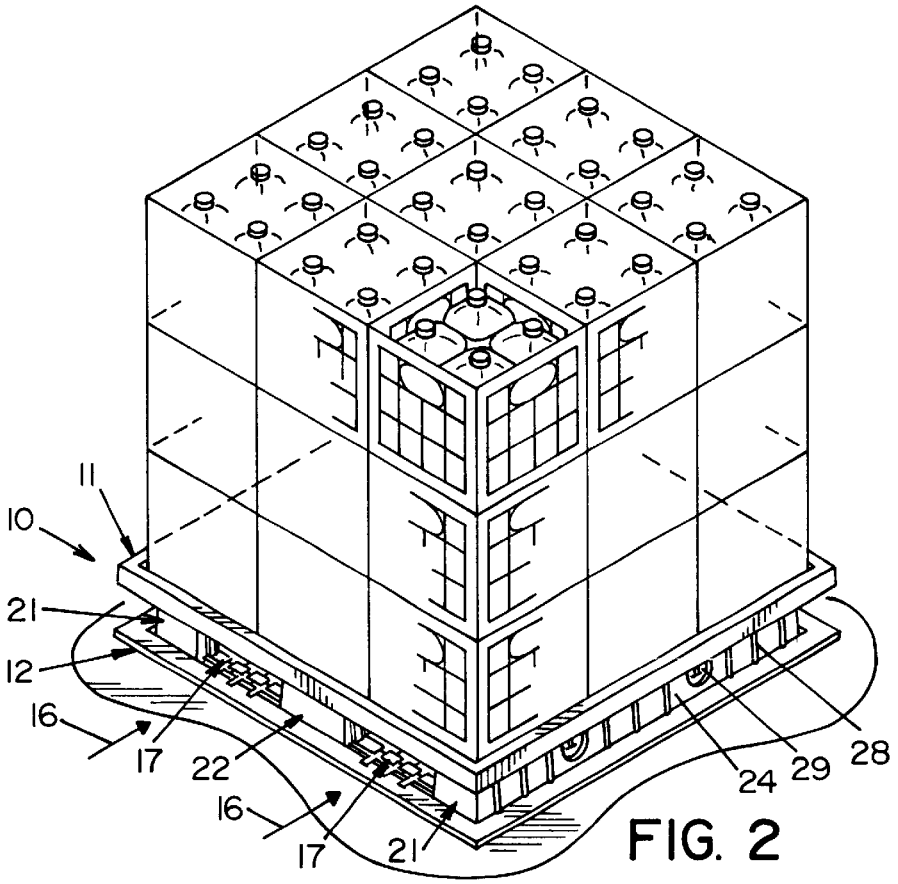
FIG. 2 is an isometric view of the pallet loaded with milk crates arranged in 3×3 layers, three layers high.
Figure 3:
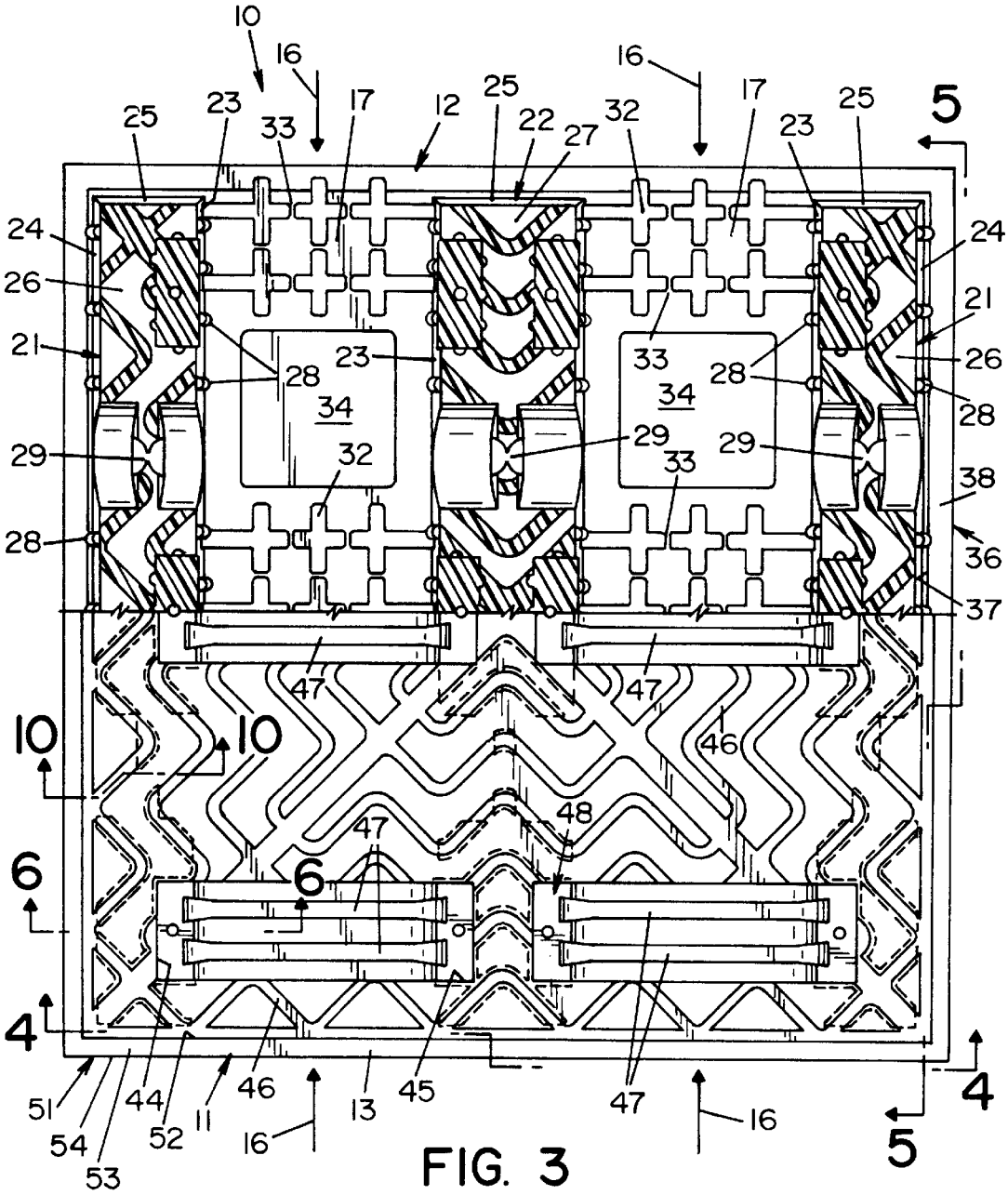
FIG. 3 is a plan view of the pallet with half of the top sheet being broken away to reveal areas in which the top sheet is fused to the bottom sheet.

As suggested in FIG. 2, a pallet 10 is proportioned to carry 3×3 layers of milk crates. The nominal size of a pallet 10 in plan view is 40"×40". The pallet has a fork entry direction indicated by arrows 16 and determined by channels or passages 17 disposed between the upper and lower sheets 11 and 12 for receiving the forks of a lift truck or floor jack.

For reference, the nominal plane of the top sheet 11 is taken as the horizontal plane in which a large collective surface area on the upper face or deck 13 is adapted to support a load. Similarly, for reference, the nominal plane of the bottom sheet 12 is taken as the plane in which the lowermost collective surface area on the lower face or base 14 of the bottom sheet exists.

The bottom or lower sheet 12 is molded with three upstanding embossments or legs 21, 22, all parallel to the fork entry direction 16. Two of the legs 21 are adjacent opposite edges of the pallet 10 and a third leg is disposed in the middle of the pallet. The legs 21, 22 extend substantially the full length of the pallet and include opposed sidewalls 23, 24 and end walls 25. The sidewalls 23, 24 are stiffened against buckling under vertical loads by vertical ribs 28 spaced along their horizontal extent. Each leg 21, 22 has a pair of pinch points 29 spaced from the end walls 25 and from each other. The pinch points 29 have wall portions 30 that are transverse to the sidewalls 23, 24 and that strengthen the sidewalls to avoid in and out flexing of such walls when carrying a load on the pallet.

Figure 4:
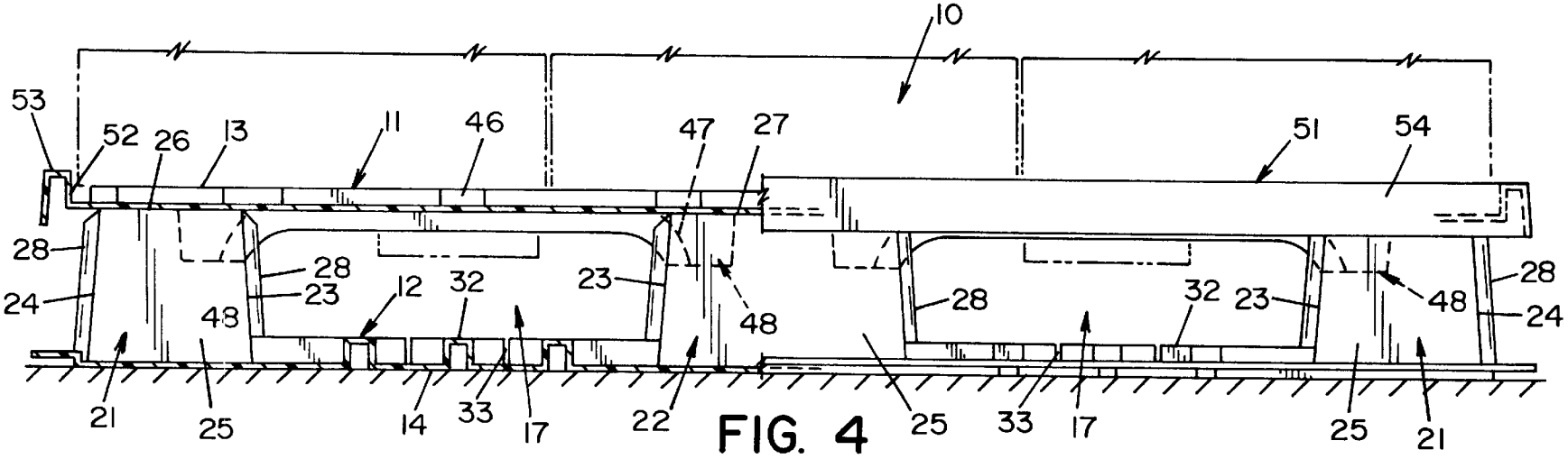
FIG. 4 is an elevational view of the pallet partially in section taken along the planes indicated by the line 4—4 in FIG. 3 and viewing the pallet along the line of fork entry.
Figure 5:
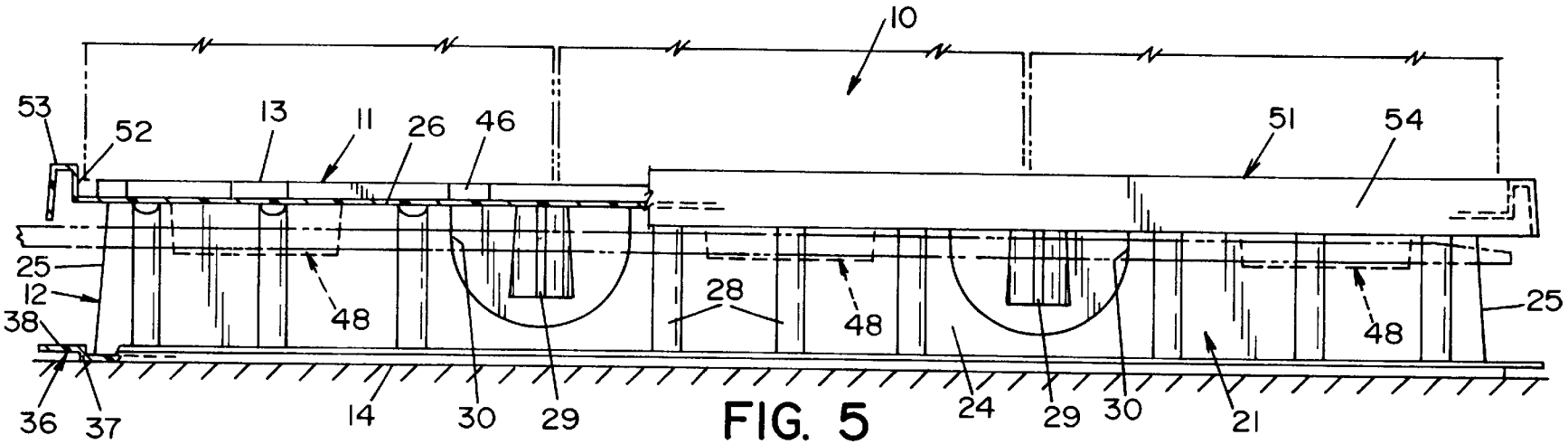
FIG. 5 is a side elevational view of the pallet partially in section taken along the planes indicated by the line 5—5 in FIG. 3.
Figure 6:
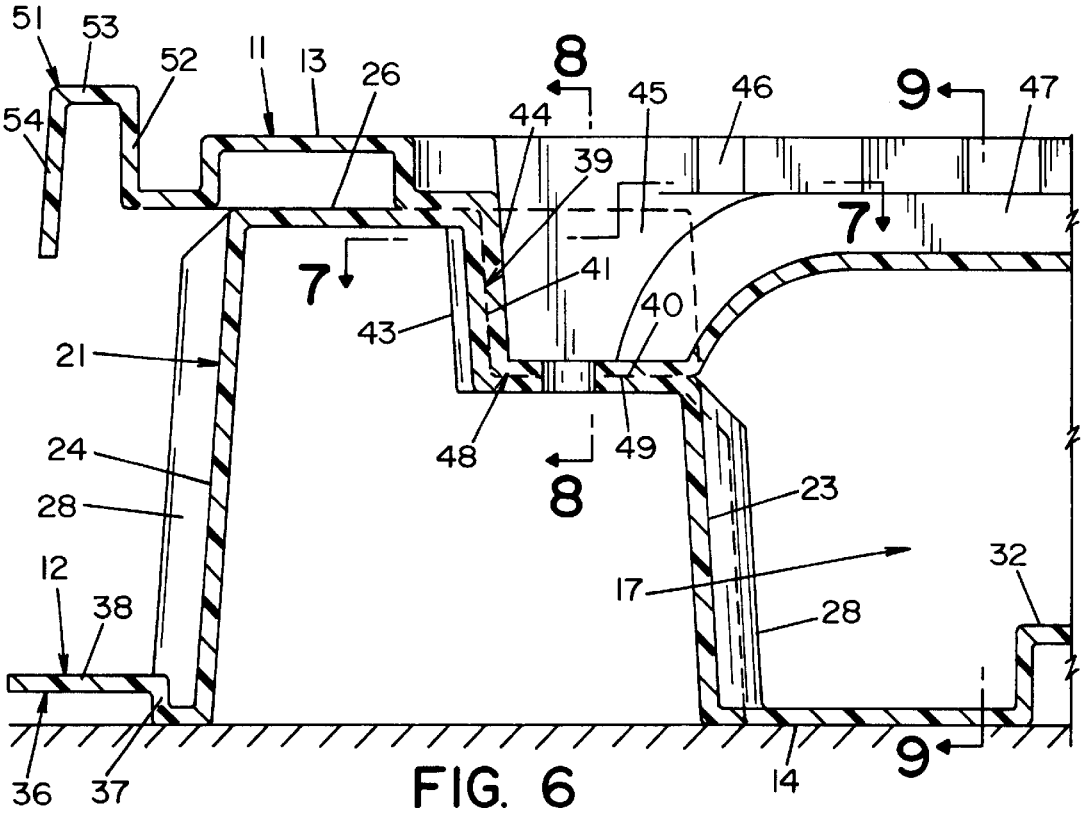
FIG. 6 is a fragmentary cross-sectional view of the pallet on an enlarged scale taken in the plane indicated by the line 6—6 in FIG. 3.
Figure 7:
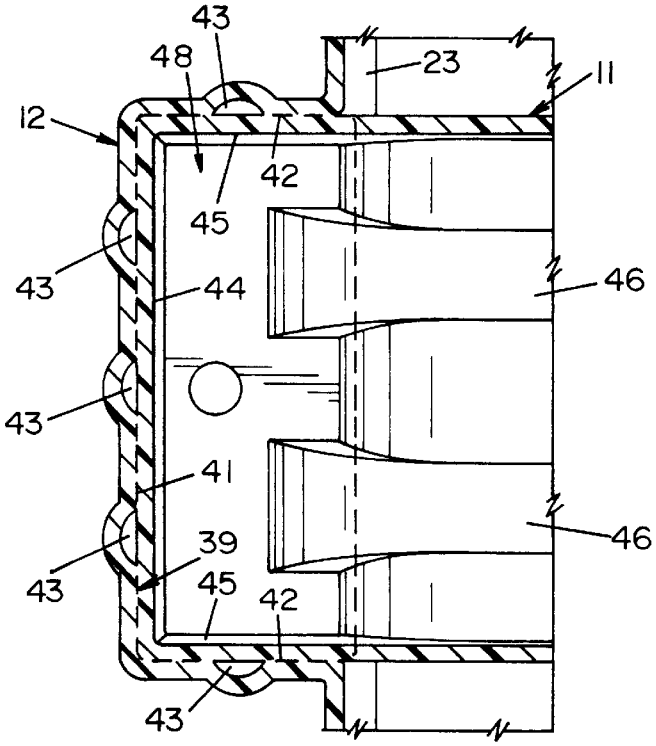
FIG. 7 is a fragmentary plan and cross-sectional view on an enlarged scale of fused wall areas of the top and bottom sheets taken in the plane indicated by the line 7—7 in FIG. 6.
Figure 8:
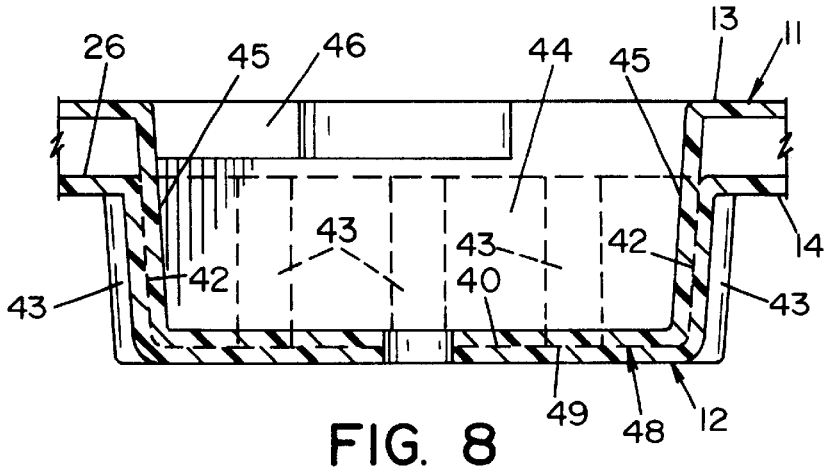
FIG. 8 is a fragmentary cross-sectional view of the pallet taken through fused areas of the top and bottom sheets along the plane indicated by the line 8—8 in FIG. 6.
Figure 9:
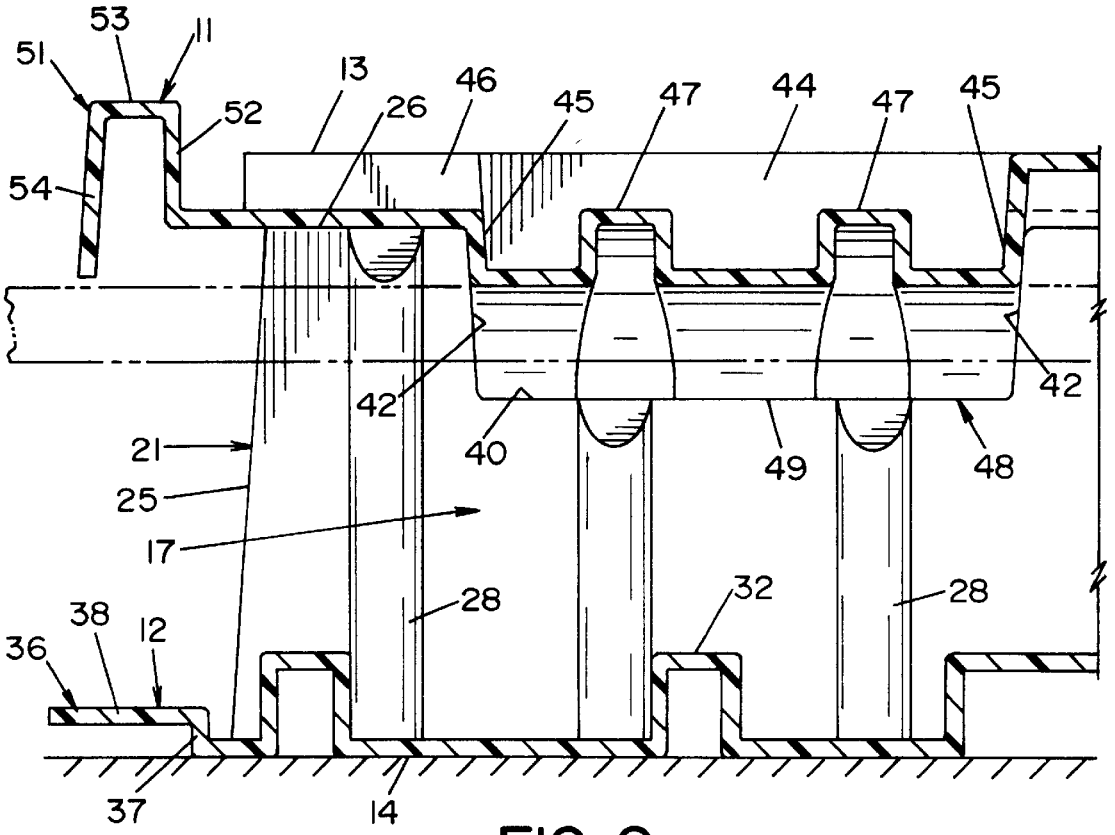
FIG. 9 is a fragmentary cross-sectional view of the pallet taken in the plane indicated by the line 9—9 indicated in FIG. 6.
Figure 10:
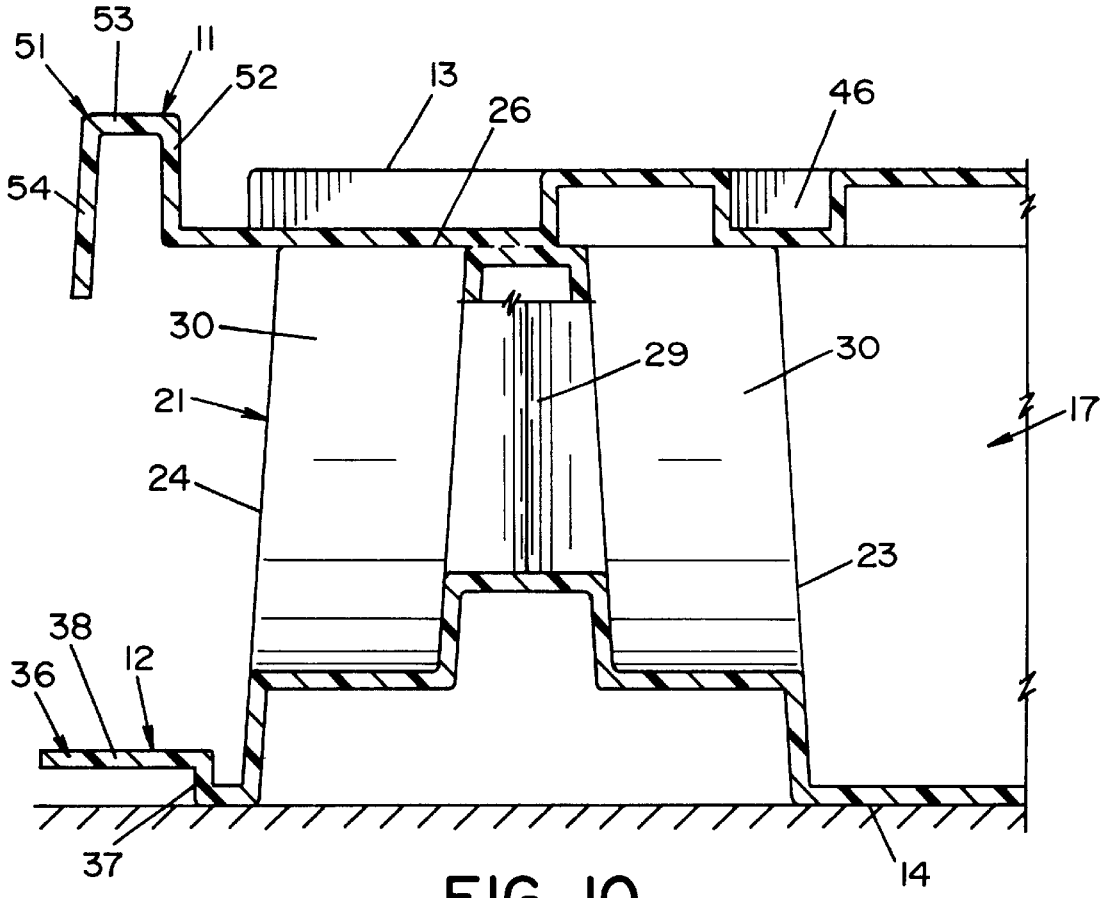
FIG. 10 is a fragmentary cross-sectional view of the pallet taken in the planes indicated by the line 10—10 in FIG. 3.
Figure 11:
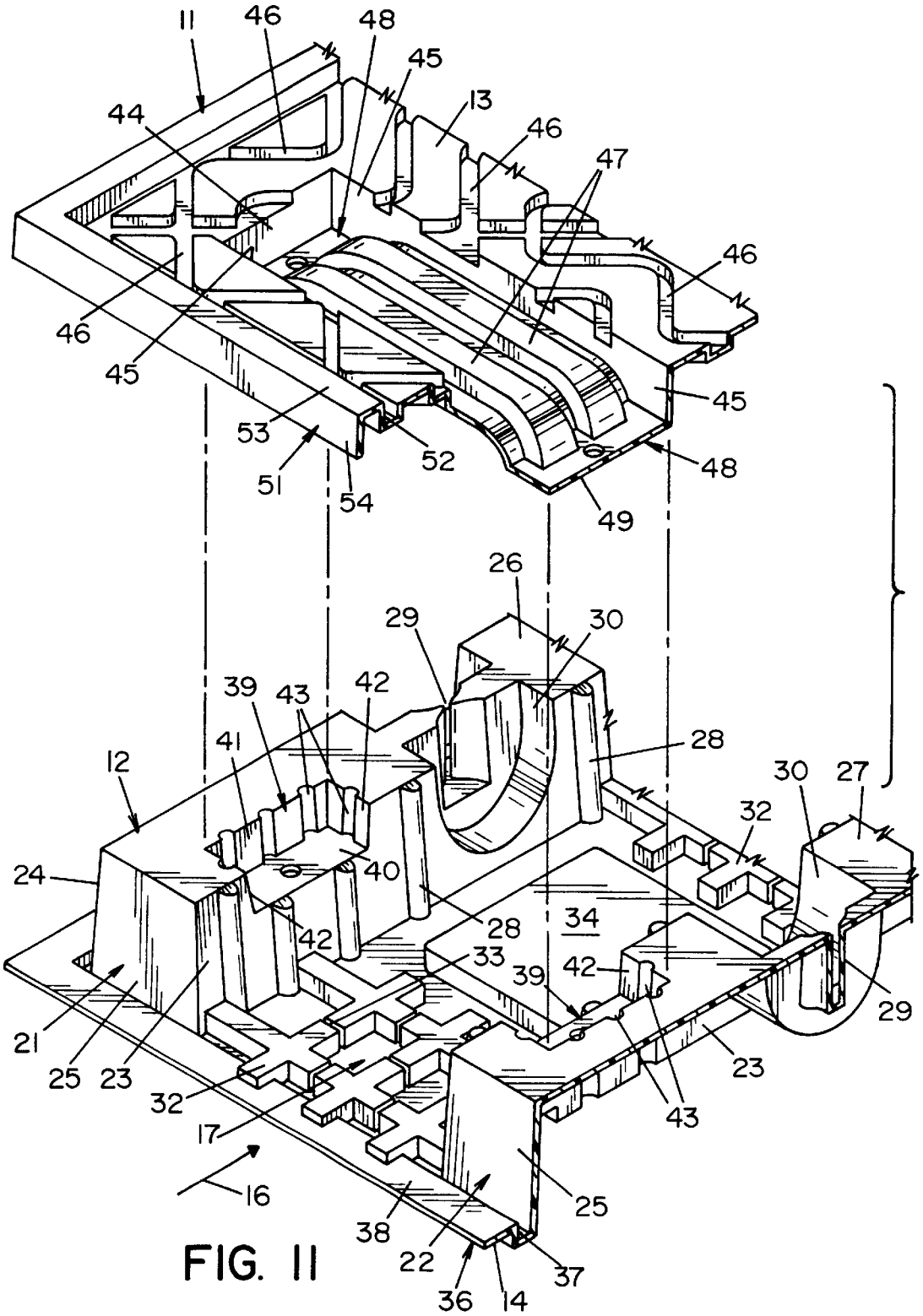
FIG. 11 is a fragmentary exploded isometric view of a typical comer portion of the pallet.

As shown in FIG. 4, the fork receiving channels 17 exist on each side of the center leg 22 between the center leg and the outer legs 21. Below the fork receiving channels or openings 17, the lower sheet 12 is molded with cruciform embossments 32 to stiffen the lower sheet; gaps 33 between the cruciform embossments 32 work as pinch points to strengthen the lower sheet 12 in both the fork entry direction 16 and in the horizontal direction perpendicular to this entry direction. Four pad-like areas 34 (a typical one is illustrated in FIG. 11) are raised slightly out of the plane of the bottom sheet lower face 14. The pads 34 serve as a template for optionally cutting out the pad area for the operation of the wheels of a floor jack. Along its full periphery, the lower sheet 12 is molded with a right angle flange 36 having a vertical section 37 and a horizontal section 38, the latter being spaced above the plane of the bottom sheet lower face 14.

A plurality of generally rectangular pockets 39 (12 in the illustrated embodiment) are formed in the upper regions of the legs 21, 22. The pockets 39 are grouped in aligned pairs formed on an outer leg 21 and an adjacent side of the center leg 22. The pockets 39 each have generally vertical side faces 41 and generally vertical opposed end faces 42. The pockets 39 are open at a side associated with the respective fork opening 17. The vertical faces 41, 42 are molded with grooves 43.

The upper sheet 11 has the majority of its plan area (i.e. as viewed from above) embossed with serpentine grooves 46 that provide strength in all directions in the plane of the upper face 13.

Arched ribs 47 are molded into the top sheet 11 at a plurality of locations where they extend across the fork receiving channels 17. In the illustrated construction, the arched ribs are at three locations distributed along the length of a fork receiving channel 17. The arched ribs 47, which are formed in adjacent pairs at each location, have their ends merged with plug-like formations 48 that are adapted to be received in respective ones of the lower sheet pockets 39 with a tight fit as discussed below. The plug formations 48 at each end of the paired arched ribs 47 include a vertical end wall 44 and oppositely facing generally vertical sidewalls 45.

The fall periphery of the top sheet 11 is molded with an inverted U-shaped flange 51. The flange 51 has an inner vertical section 52, a horizontal section 53 and an outer vertical section 54. The inner flange 52 extends above the plane of the upper face 13 of the top sheet 11 thereby enabling it to laterally restrain milk crates or other material from slipping horizontally off the top sheet. The peripheral flange 51 formed in the top sheet 11 is dimensioned to receive the vertical section 37 of the peripheral flange 36 formed in the bottom sheet 12 of an identical pallet so that empty pallets can be stably stacked and nested one upon the other.

After the top and bottom sheets 11, 12 are molded on their respective tools, the tools are forced towards one another to press the sheets into solid contact at certain locations. This pressing operation is done while the sheets are at an elevated temperature sufficiently high to enable the sheets to fuse together. The sheets 11, 12 contact on several planes including parallel planes and generally mutually perpendicular planes. The primary planes of contact are in horizontal orientations and bear the pressing force applied to the tools during the fusion step. These horizontal planes exist at the top of the legs designated 21, 22 and at the bottom surfaces, designated 40, of the pockets 39. The underside of the serpentine grooves 46 are fused onto the tops, designated 26, 27, of the legs 21, 22, and the bottoms, designated 49, of the plugs 48 contact the pocket bottoms 40.

The top and bottom sheets 11 and 12 are, additionally, fused in secondary planes generally parallel to the vertical pressing direction imposed by the tools. The secondary planes of fusion are created between the generally vertical side faces 41, 42 of the pockets 39 and the generally vertical walls 44, 45 of the plugs 48. The tools used to mold and fuse the sheets 11, 12 together, are proportioned to ensure that the vertical surfaces 44, 45 of the plugs 48 are tightly squeezed against the respective vertical surfaces 42, 41 of the pockets 39 when the sheets are pressed together. The grooves 43 in the side faces 41, 42 allow any excess material in the area of a pocket 39 and plug 48 due to variations in the manufacturing process to squish out and be received into these grooves 43. This assures that all of the design fusion areas are reliably brought into contact.

The multi-plane fusion between the top and bottom sheets 11, 12 assures a strong interconnection between these members. The arched ribs 47 serve to distribute a load when the pallet is being carried on a pair of forks uniformly to the legs 21, 22. The arched ribs 47 also stabilize the legs 21, 22 from horizontal distortion in directions perpendicular to the fork entry direction. The functions of the arched ribs 47 are enabled by the strong joints formed between the pockets 39 and plugs 48.

The coplanar load carrying surface areas of the upper face or deck 13 collectively represent an area that is a substantial fraction of the horizontal or plan area spanned by the upper sheet 11 which, in the illustrated embodiment, is essentially the same as that spanned by the pallet 10. Similarly, the lower sheet 12 has coplanar load supporting surface areas on its lower face 14 that collectively represent a substantial portion of the plan area spanned by the lower sheet 12 which in the illustrated embodiment is essentially the same as that spanned by the pallet 10. Additionally, it will be seen that the load carrying and load supporting surface areas of the top and bottom sheets 11, 12 each have outer surface portions adjacent their perimeters and inner surface portions distributed at a plurality of locations inward of their outer surface portions including locations adjacent the center of the pallet 10. The outer surface portions of the load carrying and load supporting surface areas of the top and bottom sheets 11, 12 are effectively continuous in their respective planes.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A material handling pallet formed of upper and lower thermoplastic sheets, each of said sheets spanning horizontally over a generally rectangular area, the horizontal areas spanned by each sheet being generally coextensive, the sheets being fused together at distinct separate locations distributed throughout their respective areas, the upper sheet having a horizontal load supporting surface plane defined by substantially coplanar surface area portions that collectively represent an area that is a substantial fraction of its respective horizontally spanned area, the lower sheet having on a lower face zones adjacent to its perimeter and in its midsection that are coplanar and that are adapted to transfer the weight of a load on the pallet to an underlying supporting medium, the sheets being interconnected by integrally molded legs, the sheets and legs being arranged to allow forks of a lift truck to pass between the upper and lower sheets, such that the forks pass below the upper sheet and above the lower sheet, to enable the forks to lift said pallet, said legs straddle areas that serve as fork entry channels, and said legs extend horizontally between said sheets along lines that are substantially continuous from locations adjacent one edge of the pallet to locations adjacent an opposite edge of the pallet.

2. A pallet as set forth in claim 1, wherein said legs are molded in the lower sheet.

3. A pallet as set forth in claim 2, wherein said legs have an inverted U-shape configuration that exists for a major portion of the horizontal length of the pallet measured in a direction parallel to a fork entry direction.

4. A pallet as set forth in claim 1, wherein said sheets are fused together in a plurality of planes.

5. A pallet as set forth in claim 4, wherein said planes of fusion include planes that are generally perpendicular to one another.

6. A pallet as set forth in claim 5, wherein said planes include three mutually generally perpendicular planes.

7. A pallet as set forth in claim 1, wherein said upper sheet is molded with stiffening grooves.

8. A pallet as set forth in claim 7, wherein the molded shapes of the upper and lower sheets define elongated fork entry passages extending in a direction parallel to opposite edges of the pallet, stiffening ribs molded into the upper sheet and extending over said passages in directions transverse to said entry passages.

9. A material handling pallet formed of upper and lower thermoplastic sheets, each of said sheets spanning horizontally over a generally rectangular area, the horizontal areas spanned by each sheet being generally coextensive, the sheets being fused together at distinct separate locations distributed throughout their respective areas, the upper sheet having a horizontal load supporting surface plane defined by substantially coplanar surface area portions that collectively represent an area that is a substantial fraction of its respective horizontally spanned area, the lower sheet having on a lower face zones adjacent to its perimeter and in its midsection that are coplanar and that are adapted to transfer the weight of a load on the pallet to an underlying supporting medium, the sheets being interconnected by integrally molded legs, the sheets and legs being arranged to allow forks of a lift truck to pass between the upper and lower sheets, such that the forks pass below the upper sheet and above the lower sheet, to enable the forks to lift said pallet, said legs are molded in the lower sheet, said legs have an inverted U-shape configuration that exists for a major portion of the horizontal length of the pallet measured in a direction parallel to a fork entry direction, and said legs have pinch points in the form of narrowed zones with wall portions of the legs transverse to major wall portions of the legs at locations spaced along the horizontal lengths of the legs.

10. A material handling pallet formed of upper and lower thermoplastic sheets, each of said sheets spanning horizontally over a generally rectangular area, the horizontal areas spanned by each sheet being generally coextensive, the sheets being fused together at distinct separate locations distributed throughout their respective areas, the upper sheet having a horizontal load supporting surface plane defined by substantially coplanar surface area portions that collectively represent an area that is a substantial fraction of its respective horizontally spanned area, the lower sheet having on a lower face zones adjacent to its perimeter and in its midsection that are coplanar and that are adapted to transfer the weight of a load on the pallet to an underlying supporting medium, the sheets being interconnected by integrally molded legs, the sheets and legs being arranged to allow forks of a lift truck to pass between the upper and lower sheets, such that the forks pass below the upper sheet and above the lower sheet, to enable the forks to lift said pallet, said upper sheet is molded with stiffening grooves, and said stiffening grooves are in a serpentine pattern when viewed from above the pallet.

11. A pallet as set forth in claim 10, wherein said bottom sheet is molded with stiffening embossments.

12. A pallet as set forth in claim 11, wherein said bottom sheet stiffening embossments are cruciform in shape.

13. A pallet as set forth in claim 12 wherein said cruciform embossments are spaced from one another by relatively small gaps.

14. A pallet as set forth in claim 11, wherein said lower sheet is molded with patterns adapted to be optionally cut out for clearance of the wheels of a floor jack.

15. A material handling pallet formed of upper and lower thermoplastic sheets, each of said sheets spanning horizontally over a generally rectangular area, the horizontal areas spanned by each sheet being generally coextensive, the sheets being fused together at distinct separate locations distributed throughout their respective areas, the upper sheet having a horizontal load supporting surface plane defined by substantially coplanar surface area portions that collectively represent an area that is a substantial fraction of its respective horizontally spanned area, the lower sheet having on a lower face zones adjacent to its perimeter and in its mid-section that are coplanar and that are adapted to transfer the weight of a load on the pallet to an underlying supporting medium, the sheets being interconnected by integrally molded legs, the sheets and legs being arranged to allow forks of a lift truck to pass between the upper and lower sheets, such that the forks pass below the upper sheet and above the lower sheet, to enable the forks to lift said pallet, and the upper sheet has a peripheral flange that extends above the plane of the horizontal load supporting surface, said peripheral flange being adapted to horizontally restrain goods stacked on said pallet.

16. A pallet as set forth in claim 15, wherein said pallet is substantially square.

17. A pallet as set forth in claim 16, wherein said pallet is sized to carry layers of standard milk crates in 3×3 layers.

18. A pallet as set forth in claim wherein the bottom sheet has a peripheral configuration arranged to nest with the flange of the top sheet of an identical pallet.

19. A material handling pallet formed of upper and lower thermoplastic sheets, each of said sheets spanning horizontally over a generally rectangular area, the horizontal areas spanned by each sheet being generally coextensive, the sheets being fused together at distinct separate locations distributed throughout their respective areas, the upper sheet having a horizontal load supporting surface plane defined by substantially coplanar surface area portions that collectively represent an area that is a substantial fraction of its respective horizontally spanned area, the lower sheet having on a lower face zones adjacent to its perimeter and in its mid-section that are coplanar and that are adapted to transfer the weight of a load on the pallet to an underlying supporting medium, the sheets being interconnected by integrally molded legs, the sheets and legs being arranged to allow forks of a lift truck to pass between the upper and lower sheets, such that the forks pass below the upper sheet and above the lower sheet, to enable the forks to lift said pallet, said upper sheet is molded with stiffening grooves, the molded shapes of the upper and lower sheets define elongated fork entry passages extending in a direction parallel to opposite edges of the pallet, stiffening ribs molded into the upper sheet and extending over said passages in directions transverse to said entry passages, and said stiffening ribs have ends straddling said fork entry passages, said sheets having complementary plug and pocket areas where said sheets are fused in a plurality of planes perpendicular to one another.

20. A pallet formed of upper and lower thermoplastic molded sheets, the sheets having generally coextensive rectangular horizontally extending configurations, each of said sheets having a perimeter and having outer surface areas adjacent their perimeters, said sheets each having inner surface areas distributed at a plurality of locations inward of the outer surface areas including locations adjacent the center of the pallet, said outer surface areas and said inner surface areas of each sheet being substantially coplanar and defining a load supporting plane, the outer surface areas of each sheet being effectively continuous in its respective load supporting plane, integrally molded legs supporting said sheets in a manner such that portions forming said outer and inner surface areas are spaced vertically from one another with sufficient clearance and portions forming said legs are spaced horizontally from one another with sufficient clearance to permit entry of lift forks vertically between said sheet portions and horizontally between said legs, said upper sheet has a peripheral flange that extends above the plane of the horizontal load supporting surface, said peripheral flange being adapted to horizontally restrain goods stacked on said pallet.

21. A pallet as set forth in claim 20, wherein said legs are molded in said lower sheet.

22. A pallet as set forth in claim 21, wherein said legs extend in a fork entry direction across the major part of the width of the pallet.

* * * * *